US008749155B2

(12) United States Patent
Storm

(10) Patent No.: US 8,749,155 B2
(45) Date of Patent: Jun. 10, 2014

(54) CIRCUIT ASSEMBLY FOR OPERATING AT LEAST ONE DISCHARGE LAMP

(75) Inventor: Arwed Storm, Dachau (DE)

(73) Assignee: OSRAM AG, Munich (DE)

( * ) Notice: Subject to any disclaimer, the term of this patent is extended or adjusted under 35 U.S.C. 154(b) by 177 days.

(21) Appl. No.: 13/513,596

(22) PCT Filed: Nov. 15, 2010

(86) PCT No.: PCT/EP2010/067476

§ 371 (c)(1),
(2), (4) Date: Jun. 4, 2012

(87) PCT Pub. No.: WO2011/069779

PCT Pub. Date: Jun. 16, 2011

(65) Prior Publication Data

US 2012/0242243 A1 Sep. 27, 2012

(30) Foreign Application Priority Data

Dec. 7, 2009 (DE) ..... 10 2009 047 572

(51) Int. Cl.
*H05B 41/36* (2006.01)
*H05B 37/00* (2006.01)
*H02M 3/335* (2006.01)

(52) U.S. Cl.
USPC ..... 315/210; 315/291; 363/16

(58) Field of Classification Search
USPC ..... 315/224, 291, 307, 312, 175, 210; 363/34, 16, 131
See application file for complete search history.

(56) References Cited

U.S. PATENT DOCUMENTS

| | | | | |
|---|---|---|---|---|
| 5,945,788 | A | 8/1999 | Li et al. | |
| 6,211,623 | B1 | 4/2001 | Wilhelm et al. | |
| 6,617,805 | B2 | 9/2003 | Ribarich et al. | |
| 8,022,637 | B2 * | 9/2011 | Feldtkeller et al. | 315/224 |
| 2002/0030456 | A1 | 3/2002 | Kim | |
| 2002/0126510 | A1 * | 9/2002 | Sauerlaender et al. | 363/16 |
| 2002/0126515 | A1 * | 9/2002 | Boeke | 363/34 |
| 2005/0035730 | A1 * | 2/2005 | Blum | 315/312 |
| 2006/0284572 | A1 * | 12/2006 | Busse et al. | 315/307 |
| 2011/0095705 | A1 * | 4/2011 | Holzinger et al. | 315/294 |

FOREIGN PATENT DOCUMENTS

| | | | |
|---|---|---|---|
| DE | 19900153 | A1 | 7/1999 |
| DE | 60125214 | T2 | 11/2007 |

* cited by examiner

*Primary Examiner* — Douglas W Owens
*Assistant Examiner* — Wei Chan

(57) ABSTRACT

A circuit assembly for operating a discharge lamp is disclosed having DC input terminals, a bridge circuit to implement a first bridge midpoint, an output coupling the discharge lamp thereto and a shunt resistor with a tapping point and a device for detecting overload operation. A device for ignition control of the discharge lamp, having an input for supplying a measurement signal and a switch control device is provided connected to the device for detecting overload operation and the ignition control device. The switch control device is designed to modify control signals for at least a first and second electronic switch as a function of the output signals of the device for detecting overload operation.

8 Claims, 2 Drawing Sheets

CIRCUIT ASSEMBLY FOR OPERATING AT LEAST ONE DISCHARGE LAMP

RELATED APPLICATIONS

The present application is a national stage entry according to 35 U.S.C. §371 of PCT application No.: PCT/EP2010/067476 filed on Nov. 15, 2010, which claims priority from German application No.: 10 2009 047 572.9 filed on Dec. 7, 2009.

TECHNICAL FIELD

The present invention relates to a circuit assembly for operating at least one discharge lamp, having an input with a first and a second input terminal for coupling to a DC supply voltage, a bridge circuit with at least one first and one second electronic switch, wherein the series circuit including the first and second electronic switch is coupled between the first and second input terminal to implement a first bridge midpoint, an output for coupling to the at least one discharge lamp, wherein the output is coupled to the first bridge midpoint, a shunt resistor connected in series with the second electronic switch, and a tapping point assigned to the shunt resistor for tapping off the voltage dropped across the shunt resistor during operation, a device for detecting overload operation of the at least one discharge lamp and having an input for supplying a measurement signal, a device for ignition control of the at least one discharge lamp with an input for supplying a measurement signal, and a switch control device for controlling at least the first and second electronic switch, wherein the switch control device is coupled to the device for detecting overload operation and to the ignition control device, the switch control device being designed to modify the control signals for at least the first and the second electronic switch as a function of the output signals of the device for detecting overload operation and of the ignition control device.

BACKGROUND

FIG. 1 shows, in this context, a circuit arrangement known from the prior art. This has an input having a first E1 and a second input terminal E2 between which a DC supply voltage, preferably the so-called DC link voltage $U_{ZW}$, is applied. A series connection including a first S1 and a second electronic switch S2 in half-bridge configuration and a shunt resistor $R_S$ is connected between the input terminals E1 and E2. Between the switches S1, S2, a half-bridge midpoint HBM1 is implemented which is connected to a first output terminal A1 via an inductor L1. A second half-bridge midpoint also present is not shown in FIG. 1. The first output terminal A1 forms together with a second output terminal A2 an output for coupling to at least one discharge lamp.

The switches S1, S2 are alternately rendered conducting and nonconducting in push-pull manner in the normal way by a control unit 10, in particular with a frequency ≥20 kHz. Formed between the switch S2 and the shunt resistor $R_S$ is a tapping point AP which is connected to a first input terminal EA1 of the control unit 10 via an integrator device including an ohmic resistor R3 and a capacitor C1 and is used to supply a measurement signal MS1. The input terminal EA1 is connected via a driver device 12 to a device 14 for detecting overload operation of the at least one discharge lamp. A voltage divider including the ohmic resistors R1 and R2 is connected in parallel with the shunt resistor R. The tapping point of the voltage divider R1, R2 is coupled to a second input terminal EA2 of the control unit 10 to supply a second measurement signal MS2. The measurement signal MS2 at the input terminal EA2 is fed via a driver device 16 to a device 18 for ignition control of the at least one discharge lamp.

Devices for detecting overload operation and devices for ignition control are sufficiently known from the prior art.

Here the need for ignition control results from the fact that a predefinable maximum ignition voltage must not be exceeded, in order to prevent damage to a generic circuit assembly. On the other hand, ignition control is used to disconnect the circuit assembly when the discharge lamp is removed in order to prevent malfunctions or rather avoid posing a hazard to persons who might touch the output terminals A1 and A2. For ignition control purposes, the peak value $\hat{U}_S$ of the voltage $U_S$ dropped across the shunt resistor $R_S$ is evaluated.

The need to detect overload operation results from the fact that circuit assemblies with a constant output current characteristic have the disadvantageous property of using significantly increased system power to operate discharge lamps that possess an excessively high lamp voltage because of manufacturing-related impurities. This applies in particular to compact fluorescent lamps. Without suitable countermeasures, overheating of the discharge lamp and/or circuit assembly may occur. For this purpose the output power $P_{out}$ is monitored during operation of the circuit assembly. At constant DC link voltage $U_{ZW}$, a linear relationship exists between this power and the average value $\bar{I}_S$ of the current $I_S$ through the shunt resistor $R_S$, i.e. $P_{out}=\bar{I}_S \times U_{ZW}$.

In the context of ignition control and overload control, the switch control device 20 is designed to vary the frequency of the control signals of the switches S1 and S2 appropriately.

The control unit 10 has a switch control device 20 which is connected to the device 14 for detecting overload operation and the ignition control device 18. The switch control device 20 is designed to modify the control signals for the first S1 and the second electronic switch S2 as a function of the output signals of the device 14 for detecting overload operation and of the ignition control device 18. The shunt resistor $R_S$ is used here for overload control parameterization and the voltage divider R1, R2 for ignition control parameterization.

The disadvantage of this known circuit assembly is the fact that, to implement the two functions—ignition control and overload control—two measurement signals must be fed to the control unit 10, namely the measurement signals MS1 and MS2 as shown in FIG. 1. Two measurement lines are required for this purpose, which means that two pins have to be provided on the housing of the control unit 10.

SUMMARY

Various embodiments further develop the circuit assembly as described in the background such that it can be implemented less expensively and as compactly as possible.

Various embodiments can be achieved by enabling ignition control and overload control to be implemented using a single measurement line. Despite the reduction to a single measurement line, a means of parameterizing ignition control and overload control separately from one another may be provided. This can be achieved in that the input of the device for detecting overload operation and the input of the ignition control device are interconnected to form a common coupling point. The circuit assembly additionally includes at least one ohmic resistor connected in series between the tapping point assigned to the shunt resistor and the common coupling point, and also a power source which is connected to the common coupling point.

This enables ignition control to be parameterized via the value of the shunt resistor and subsequently, at a then predefined value of the shunt resistor, the overload control by the value of the ohmic resistor. This procedure means that only one pin needs to be provided on the control unit for supplying a single measurement signal. This results in a cost reduction and also reduces the mounting space required.

In a preferred embodiment, the switch control device is designed to deactivate the power source during the phase in which the second electronic switch is rendered conducting, and to activate it during the phase in which the first electronic switch is rendered conducting. This procedure means that during the phase in which the second electronic switch is rendered conducting, the peak value of the voltage dropped across the shunt resistor can be detected and evaluated for ignition control.

The device for detecting overload operation is preferably an integrator device which is used to determine an average value of the current through the shunt resistor. The device for detecting overload operation is preferably designed to evaluate the signal at the common coupling point continuously, i.e. irrespective of whether the power source is activated or deactivated. After averaging, this signal is composed of a component that is proportional to the average value of the current through the shunt resistor, and a component that is proportional to the voltage dropped across the ohmic resistor as a result of activation of the power source. Overload control can be parameterized on the basis of this second component even after the shunt resistor value has already been defined for ignition control parameterization.

Even though the device for detecting overload operation, the ignition control device and the switch control device may be implemented separately, it is particularly advantageous if they are all incorporated in a control unit. Such a control unit is preferably implemented as an ASIC (application specific integrated circuit).

Further advantageous embodiments will emerge from the sub-claims.

BRIEF DESCRIPTION OF THE DRAWINGS

An exemplary embodiment of a circuit assembly according to the invention will now be explained in greater detail with reference to the accompanying drawings in which.

DETAILED DESCRIPTION

The following detailed description refers to the accompanying drawings that show, by way of illustration, specific details and embodiments in which the invention may be practiced.

Figure 1:
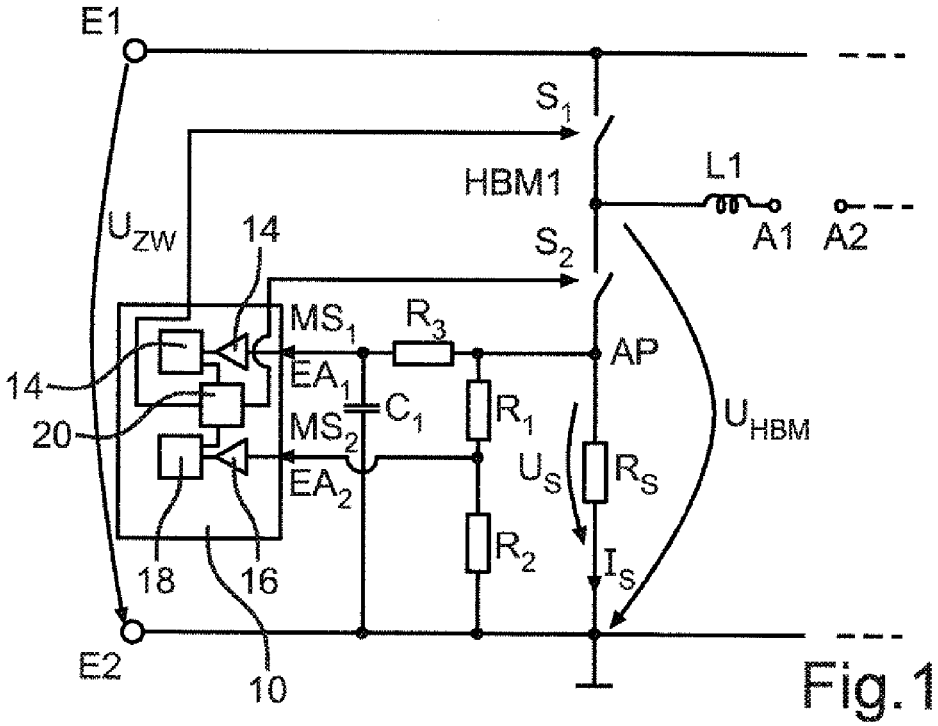
Fig.1 (Prior art)
FIG. 1 schematically illustrates a prior art circuit assembly for operating at least one discharge lamp.
Figure 2:
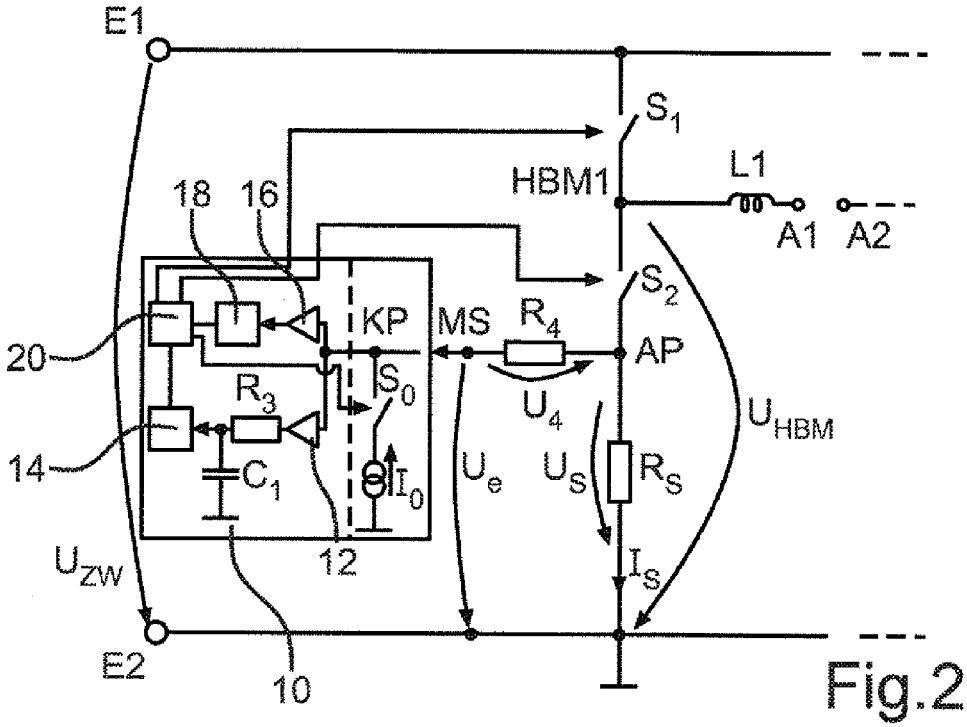
FIG. 2 schematically illustrates a circuit assembly according to the invention for operating at least one discharge lamp.

FIG. 2 schematically illustrates an exemplary embodiment of a circuit assembly according to the invention for operating a discharge lamp (not shown) which can be connected between the output terminals A1, A2. In so far as they relate to the same or similar components, the reference characters introduced in connection with FIG. 1 will be adopted for the embodiment of an inventive circuit assembly shown in FIG. 2, and will not be re-introduced.

The ignition control device 18 and the device 14 for detecting overload operation are interconnected on the input side, forming a coupling point KP. In this respect only a single measurement signal MS is fed to the control unit 10. A power source $I_0$ is connected to the coupling point KP, wherein a switch $S_0$ is connected between the coupling point KP and the power source $I_0$ and is controlled by the switch control device 20, as will be described in greater detail below. An ohmic resistor $R_4$ is connected between the coupling point KP and the tapping point AP; the voltage dropped across the ohmic resistor $R_4$ is denoted by $U_4$. The value of the resistor $R_4$ is very much greater than the value of the shunt resistor $R_S$. In a preferred exemplary embodiment, the value of the shunt resistor is $\leq 1\Omega$ and value of the ohmic resistor $R_4$ is $\geq 1$ k$\Omega$.

While the second electronic switch S2 is conducting, the relation is given by: $U_e = I_S \times R_S$.

The peak value $\hat{U}_e$ of the voltage $U_e$ is given by: $\hat{U}_e = \hat{I}_S \times R_S$.

The peak value $\hat{U}_e$ of the voltage $U_e$ can be used for ignition control, parameterization being performed by appropriate dimensioning of the shunt resistor $R_S$.

For overload control, the average value $\overline{U}_e$ of the voltage $U_e$ is determined, it having to be taken into account that the switch $S_0$ is rendered conducting during the phase in which the switch S2 is nonconducting. In terms of the average value we therefore get:

$$\overline{U}_e = (\overline{I}_S \times R_S + I_0 \times (t_{on}/T) \times R_4).$$

where $t_{on}$ is the time during which the switch $S_0$ is rendered conducting within the period T defined by the frequency in the control signals of the switches S1 and S2. This shows that, even after specifying the shunt resistor $R_S$ for ignition control parameterization, overload control can be parameterized by dimensioning of the ohmic resistor $R_4$ (or rather of the power source $I_0$), even though the control unit 10 is only supplied a single measurement signal, namely the measurement signal MS.

Figure 3:
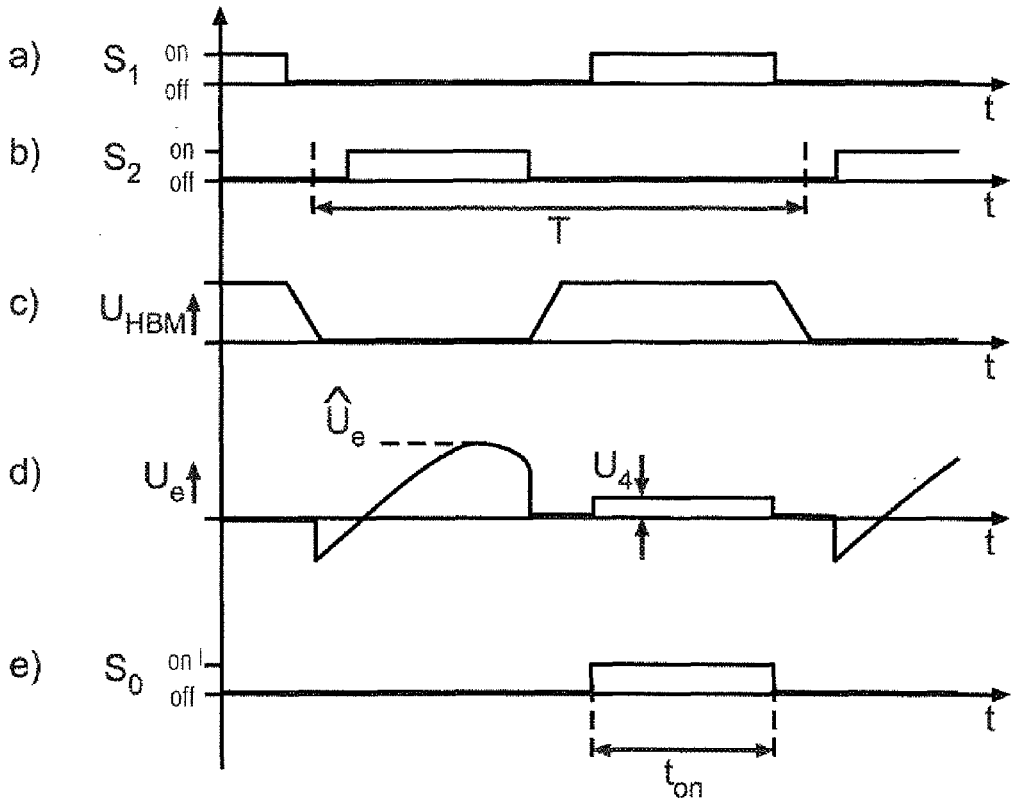
FIG. 3 shows the waveforms of various electrical quantities of the embodiment of a circuit assembly according to the invention as illustrated in FIG. 2.

FIG. 3 schematically illustrates the waveforms of different variables of the embodiment of a circuit assembly according to the invention as shown in FIG. 2. Waveforms a) and b) each indicate when the switches S1 and S2 respectively are turned on or off respectively. Waveform c) represents the voltage $U_{HBM}$ at the half-bridge midpoint HBM1. As is evident, the reference potential is pulled up to the half-bridge midpoint HBM1 during the phases in which the switch S2 is ON, so that the potential $U_{HBM}$ at the half-bridge midpoint HBM1 is 0 during the phases in which the switch S2 is ON. During the phases in which the switch S1 is ON (conducting) and the switch S2 is OFF (nonconducting), the potential of the DC link voltage $U_{ZW}$ appears at the half-bridge midpoint HBM1. Waveform d) shows the response of the voltage $U_e$. During the phases in which the switch S2 is turned on, the voltage initially exhibits a negative component. This is due to the fact that, during commutation, a portion of the load current initially flows through a freewheel diode associated with the switch S2 before the switch S2 itself is rendered conducting. During purely inductive operation with a high reactive component, the negative region of the voltage $U_e$ is large, but reduces in the case of a high active component. During ignition, immediately prior to breakdown of the gas discharge gap of the discharge lamp connected to the output terminals A1, A2, i.e. in the state of high reactive power and no active power, the negative and positive current integrals approximately cancel each other out. The voltage $U_e$ waveshape is virtually triangular in the ignition region. During the phase in which the switch S1 is rendered conducting, the switch $S_0$ is also rendered conducting. As a result of the current $I_0$ then flowing, a voltage $U_4$ is dropped across the ohmic resistor $R_4$.

The voltage $U_S$ dropped across the shunt resistor $R_S$ as a result of the current $I_0$ is negligible compared to the voltage $U_4$.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A circuit assembly for operating at least one discharge lamp, the circuit assembly comprising:

an input having a first and a second input terminal for coupling to a DC supply voltage;

a bridge circuit having at least one first and one second electronic switch, wherein the series circuit comprising the first and the second electronic switch is connected between the first and the second input terminal to implement a first bridge midpoint;

an output to couple to at least one discharge lamp, wherein the output is connected to the first bridge midpoint;

a shunt resistor which is connected in series with the second electronic switch, and a tapping point assigned to the shunt resistor for tapping off the voltage dropped across the shunt resistor during operation;

a device configured to detect overload operation of the at least one discharge lamp, having an input for supplying a measurement signal;

a device configured to ignition control of the at least one discharge lamp, having an input for supplying a measurement signal; and a switch control device configured to control at least the first and the second electronic switch, wherein the switch control device is connected to the device configured to detect overload operation and the ignition control device, said switch control device being designed to modify the control signals for at least the first and the second electronic switch as a function of the output signals of the device configured to detect overload operation and the ignition control device;

wherein the input of the device configured to detect overload operation and the input of the ignition control device are interconnected to form a common coupling point;

wherein the circuit assembly additionally comprises:

at least one ohmic resistor which is connected in series between the tapping point assigned to the shunt resistor and the common coupling point; and a power source which is connected to the common coupling point.

2. The circuit assembly as claimed in claim 1, wherein the switch control device is designed to deactivate the power source during the phase in which the second electronic switch is rendered conducting, and to activate it during the phase in which the first electronic switch is rendered conducting.

3. The circuit assembly as claimed in claim 1, wherein the ignition control device is configured to evaluate the signal at the common coupling point during the phase in which the power source is deactivated.

4. The circuit assembly as claimed in claim 1, wherein the device configured to detect overload operation is assigned an integrator device.

5. The circuit assembly as claimed in claim 4, wherein the device configured to detect overload operation is designed to evaluate the signal at common coupling point continuously, irrespective of whether the power source is activated or deactivated.

6. The circuit assembly as claimed in claim 1, wherein the device configured to detect overload operation, the ignition control device and the switch control device are incorporated in a control unit.

7. The circuit assembly as claimed in claim 1, wherein ignition control can be parameterized via the value of the shunt resistor.

8. The circuit assembly as claimed in claim 1, wherein overload control can be parameterized via the value of the ohmic resistance for a predefined value of the shunt resistor.

* * * * *

UNITED STATES PATENT AND TRADEMARK OFFICE

CERTIFICATE OF CORRECTION

PATENT NO. : 8,749,155 B2
APPLICATION NO. : 13/513596
DATED : June 10, 2014
INVENTOR(S) : Arwed Storm It is certified that error appears in the above-identified patent and that said Letters Patent is hereby corrected as shown below:

In the Specification

Column 1, line 65, delete "shunt resistor R." and write "shunt resistor $R_s$." in place thereof. (Please note that the "s" is a subscript.)

Signed and Sealed this
Ninth Day of September, 2014

Michelle K. Lee

Michelle K. Lee
*Deputy Director of the United States Patent and Trademark Office*